US007438674B2

(12) United States Patent
Sjödin

(10) Patent No.: US 7,438,674 B2
(45) Date of Patent: Oct. 21, 2008

(54) EXERCISING DEVICE

(76) Inventor: Torbjörn Sjödin, Kaptensgatan 14, Stockholm (SE) SE-114 57

( * ) Notice: Subject to any disclaimer, the term of this patent is extended or adjusted under 35 U.S.C. 154(b) by 0 days.

(21) Appl. No.: 10/566,576

(22) PCT Filed: Aug. 5, 2004

(86) PCT No.: PCT/SE2004/001164

§ 371 (c)(1),
(2), (4) Date: Jul. 19, 2006

(87) PCT Pub. No.: WO2005/014119

PCT Pub. Date: Feb. 17, 2005

(65) Prior Publication Data

US 2006/0264302 A1 Nov. 23, 2006

(30) Foreign Application Priority Data

Aug. 8, 2003 (SE) ..... 0302185

(51) Int. Cl.
*A63B 21/002* (2006.01)
*A63B 21/012* (2006.01)

(52) U.S. Cl. ..... 482/91; 482/114; 482/904

(58) Field of Classification Search ..... 482/121, 482/122, 126, 904, 91, 114
See application file for complete search history.

(56) References Cited

U.S. PATENT DOCUMENTS 3,608,900 A * 9/1971 Welch ..... 482/120
3,752,474 A * 8/1973 Macabet et al. ..... 482/131
4,060,240 A * 11/1977 Dunston ..... 482/131
4,245,839 A * 1/1981 Trent ..... 482/92
4,733,862 A * 3/1988 Miller ..... 482/126
4,738,444 A * 4/1988 Linden ..... 482/24
4,779,867 A * 10/1988 Hinds ..... 482/126
5,133,700 A * 7/1992 Braathen ..... 482/51
5,857,949 A 1/1999 Tebbe et al.
6,450,929 B1 * 9/2002 Markham ..... 482/121
6,662,651 B1 12/2003 Roth
6,726,606 B2 * 4/2004 Jacobsen ..... 482/121
6,921,654 B2 * 7/2005 Abu-Threideh et al. ..... 435/194
2002/0022555 A1 * 2/2002 Nesci ..... 482/91
2004/0204300 A1 * 10/2004 Hetrick ..... 482/91

FOREIGN PATENT DOCUMENTS

FR 1400480 4/1965

* cited by examiner

*Primary Examiner*—LoAn H. Thanh
*Assistant Examiner*—Allana Lewin
(74) *Attorney, Agent, or Firm*—Young & Thompson

(57) ABSTRACT

An exercising device includes a first strap (1), loops (3, 7) attached to the first strap (1) and an anchorage element (11) that is intended to be fixed to a base, the anchorage element (11) being designed to receive the first strap (1) in such a way that the first strap (1) is displaceable in its longitudinal direction relative to the anchorage element (11). It is significant that at least one loop (3, 7) has such a length/circumference that it may be mounted around the body, e.g. the waist of the chest, of a user.

17 Claims, 5 Drawing Sheets

EXERCISING DEVICE

TECHNICAL FIELD OF THE INVENTION

The present invention relates to an exercising device that comprises a first strap, loops attached to the first strap and an anchorage means that is intended to be fixed to a base, said anchorage means being designed to receive the first strap in such a way that the first strap is displaceable in its longitudinal direction relative to the anchorage means.

PRIOR ART

From U.S. Pat. No. 4,060,240 an exercising device is previously known, said device comprising a strap, to which two loops are attached, said strap extending around a pulley in a block, to which means for anchoring of the block is attached, e.g. between a door leaf and a door frame. One loop has an attachment to the strap that may be displaced along the strap. The loops are only intended to receive a hand or a foot of the user.

From U.S. Pat. No. 5,944,640 an exercising device is previously known, said device comprising a rope that is equipped with a number of fixed attachment loops at a certain mutual distance along the rope. By means of one of the attachment loops the rope may be anchored in a hook or the like that for instance is secured to a wall. A handle is provided at the end of the rope that faces away from the hook, said handle being grabbed by the user when different exercising movements are to be carried out. The device according to U.S. Pat. No. 5,944,640 also comprises a foot support for supporting the feet of the user.

OBJECTS AND FEATURES OF THE INVENTION

A primary object of the present invention is to present and exercising device of the type defined above, said device allowing an extremely large number of exercises for different parts of the human body.

A further object of the present invention is that in connection with a preferred embodiment the resistance that is transferred to the user may be varied.

Still a further object of the present invention is that in connection with a preferred embodiment the user is given a steady standing relative to the base.

BRIEF DESCRIPTION OF THE DRAWINGS

Below an embodiment of the invention will be described, reference being made to the accompanying drawings, where also the use of the invention will be illustrated.

DETAILED DESCRIPTION OF A PREFERRED EMBODIMENT OF THE INVENTION

Figure 1:
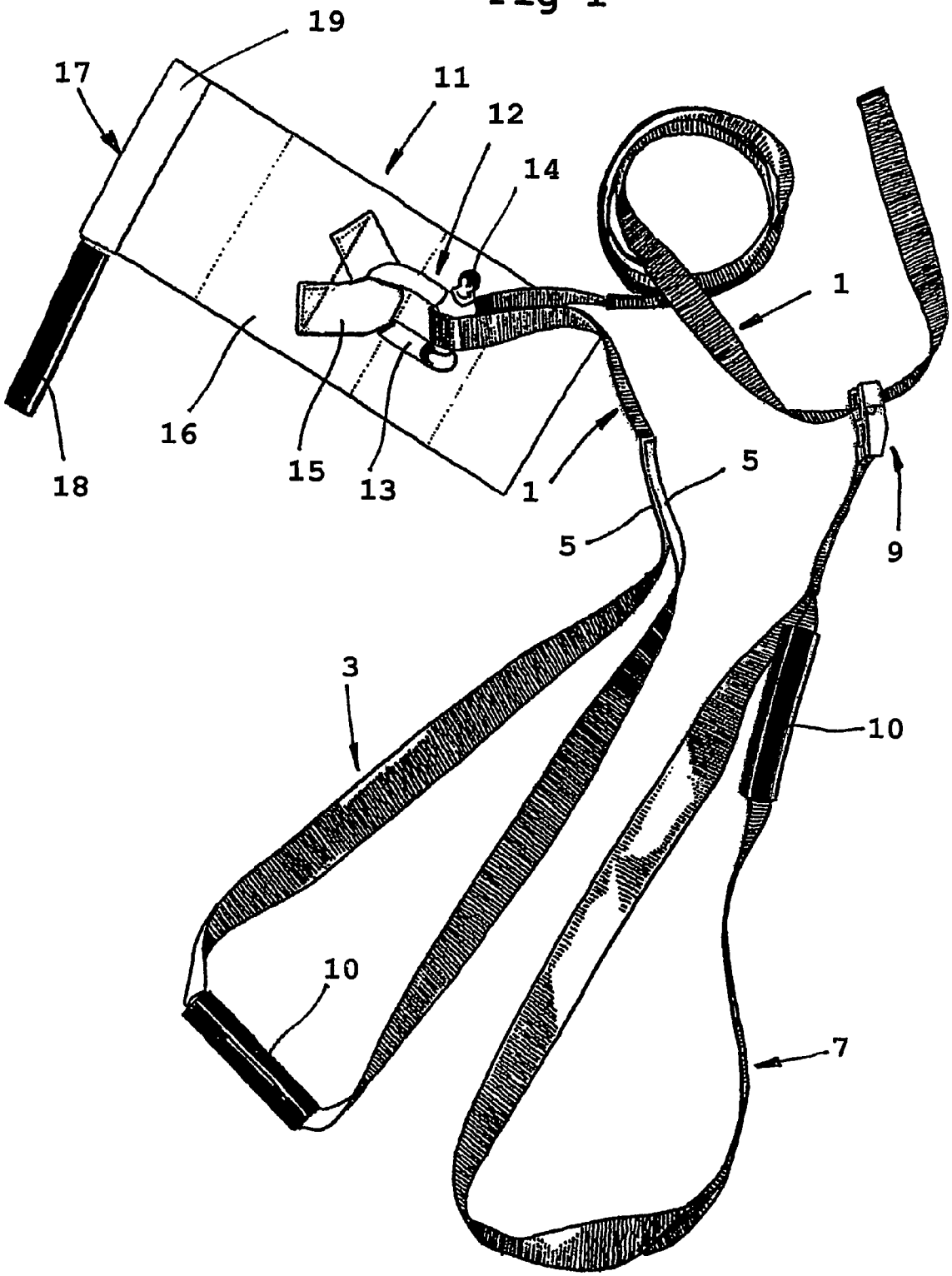
FIG. 1 shows a perspective view of an embodiment of the exercising device according to the present invention.

The exercising device shown in FIG. 1 comprises a first strap 1 that is essentially rigid in its longitudinal direction. The device also comprises a first loop 3 that in the shown embodiment is designed from a similar second strap as the first strap 1. However, the second strap of the first loop 3 has a larger width, the importance of this will be explained below, especially in connection with FIG. 3. The first loop 3 is connected to the first strap 1 by having the ends 5 of the second strap sewn to the first strap 1, said second strap defining the first loop 3.

A second loop 7 that is part of the exercising device is attached to the first strap 1 via a buckle 9 that cooperates with a part of the first strap 1 in such a way that the buckle 9 in activated condition is fixed relative to the first strap 1. Thereby, it is possible to adjust the length of the first strap 1 between the two loops 3 and 7. Also the second loop 7 is designed from a second strap that has a larger width than the first strap 1. The second straps are essentially non-extendable in their longitudinal direction.

As is evident from FIG. 1 a tubular handle 10 is received on each one of the loops 3 and 7, said tubular handles 10 being displaceable along the loops 3 and 7. In connection therewith the second straps forming the loops 3 and 7 preferably has a width that is larger than the internal diameter of the handles 10. This means that the handles 10 are displaceable along the loops 3 and 7 against a certain resistance, i.e. the handles 10 are not sliding freely along the loops 3 and 7 but they have to be displaced manually along the loops 3 and 7 in order to achieve a new position. In exemplifying and non-restricting purpose it should be mentioned that the tubular handles 10 may be manufactured from a relatively stiff polyurethane plastic or from anodised aluminium. The tubular handles 10 preferably have such an inherent stiffness that they are shape permanent relative to the straps in the loops 3 and 7.

The exercising device according to the present invention also comprises an anchorage means 11, said first strap 1 cooperating with said anchorage means 11 in a way that will be described in detail below. In the shown embodiment the anchorage means 11 comprises a U-shaped schackle 12 that consists of a yoke 13 and a threaded screw 14 at one end of the yoke 13. As is evident from FIG. 1 the schackle 12 defines a closed opening, through which the first strap 1 passes. The anchorage means 11 also comprises an eye, a sheet shaped carrier 16 for the eye 15 and a bead 17 integrated with the carrier 16, said bead 17 being achieved by having a rod shaped element 18 received in a pocket 19 in the carrier 16. The eye 15 is preferably manufactured from a strip of flexible material, the ends of the strip being sewn to the carrier 16 that likewise preferably is manufactured from a flexible material. The yoke 13 of the schackle 12 is received in the eye 15.

Figure 2:
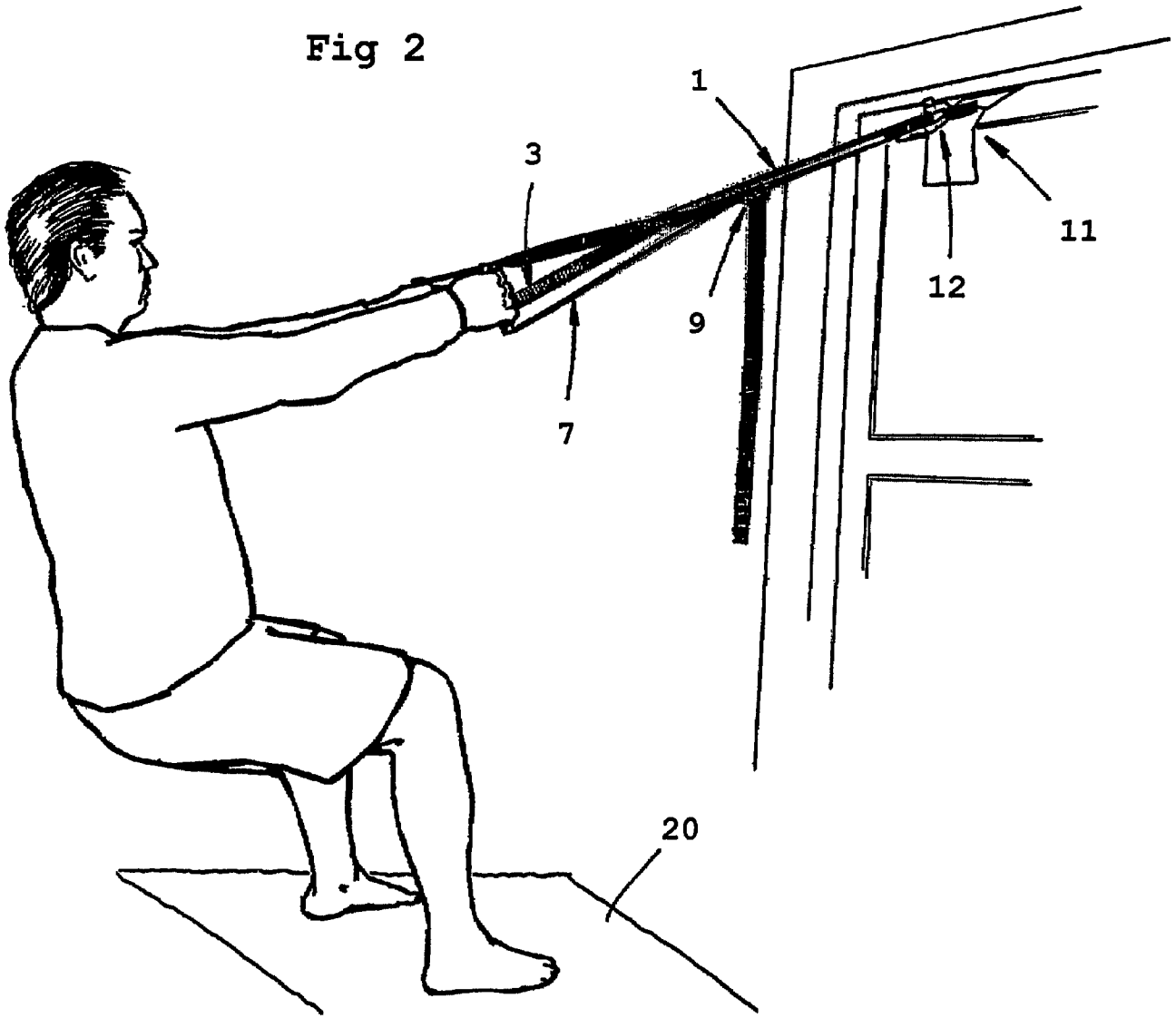
FIG. 2 shows schematically how a first exercise may be performed by means of the exercising device according to the present invention.

The use of the exercising device according to the present invention will be illustrated with reference to FIGS. 2-4. In FIG. 2 an exercise is illustrated where the user with one hand has grabbed the first loop 3 and with the other hand has grabbed the second loop 7. Normally, the user has grabbed the respective tubular handles 10 that are received in each loop 3, 7. In connection therewith, the anchorage means 11 has been placed between the upper, horizontal edge of a door leaf and the adherent part of the frame. As is evident from FIG. 2 the user is standing on an antislip mat 20 that constitutes a preferred part of the exercising device according to the present invention, it should however be pointed out that the antislip mat 20 does not constitute a compulsory part of the exercising device according to the present invention. The antislip mat 20 is manufactured from a material that on one hand establishes proper friction against the base/floor and on the other hand establishes proper friction against the soles of the user's feet or his/her footwear. In the position shown in FIG. 2 the user is leaning somewhat backwards with bended knees and essentially stretched arms. In connection therewith the user may either pull himself/herself towards the door with both arms simultaneously or alternately with one arm at a time. In the latter situation the first strap 1 will be displaced in its longitudinal direction relative to the shackle 12.

Figure 3:
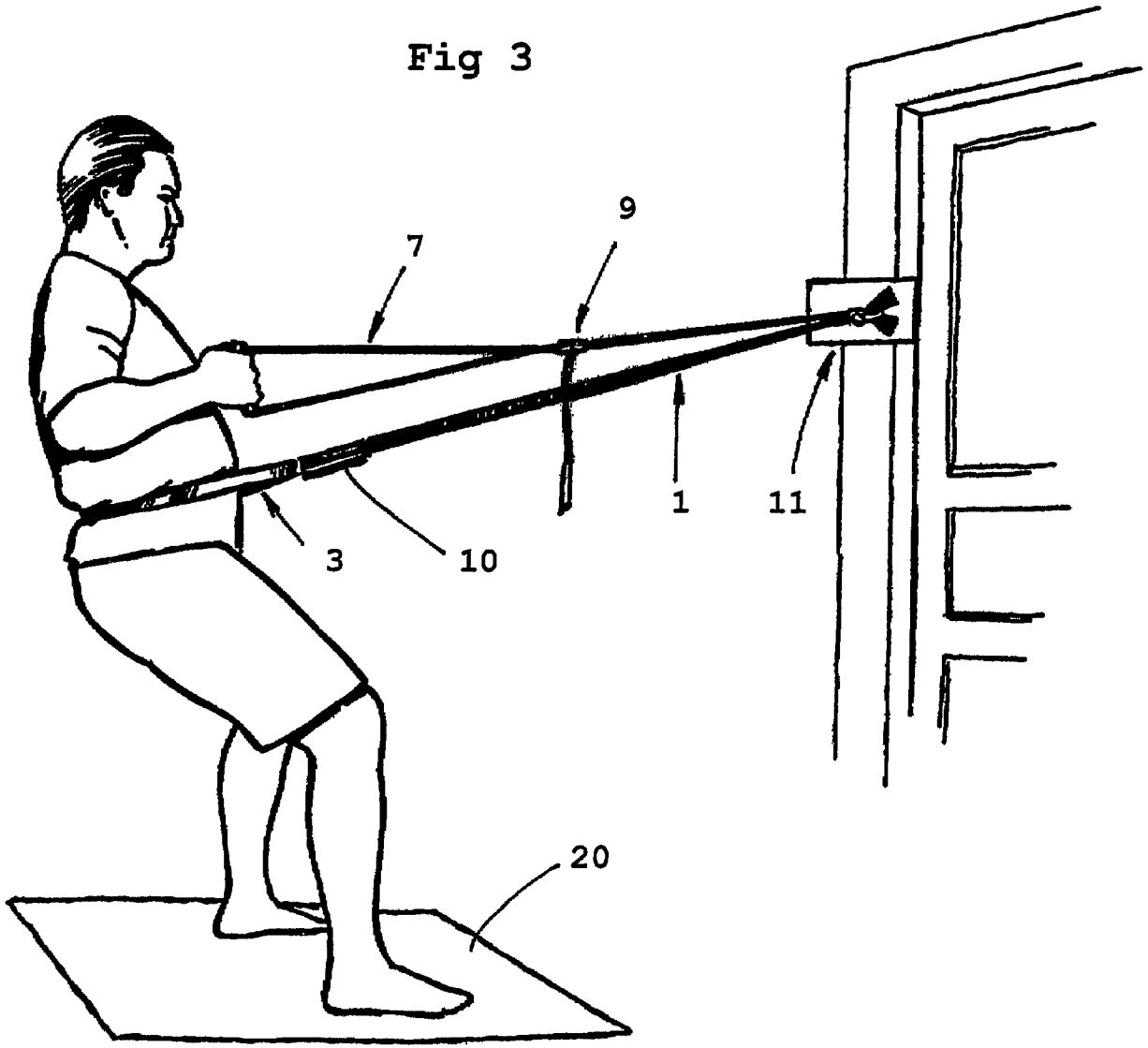
FIG. 3 shows schematically how a second exercise may be performed by means of the exercising device according to the present invention.

In FIG. 3 an exercise is illustrated where the first loop 3 is located around the waist of the user that with one hand has grabbed the second loop 7 and more precisely the handle 10 of the second loop 7. In this connection it should be emphasised that the possibility of the user to locate the first loop 3 around the waist constitutes an extremely important feature of the exercising device according to the present invention. Therewith, the length of the loop 3 must of course be such that this is made possible and it should be seen to that also tall and corpulent persons are able to use the exercising device according to the present invention. In the shown embodiment the second loop 7 in principal has the corresponding demensions as the first loop 3, i.e. the user may instead choose to locate the second loop 7 around his/her waist. The larger width of the second straps that form the loops 3 and 7 guarantees that these loops 3 and 7 do not create an unpleasant indentation in the waist of the user. In exemplifying and non-restricting purpose it is stated that a suitable length/circumference of the loops 3 and 7 is in the interval 110-180 cm, preferably in the interval 120-160 cm. As is evident from FIG. 3 the user has displaced the handle 10 to the portion of the first loop 3 that is adjacent to the first strap 1. Thereby, it is guaranteed that the handle 10 normally does not abut the body of the user. In this connection it should also be mentioned that a normal length of the first strap 1, between the loops 3, 7, is in the interval 250-350 cm.

In this case the anchorage means 11 is attached between a vertical edge of the door leaf and the adherent part of the frame. Also in this case the user is leaning slightly backwards and is standing on an antislip mat 20. A suitable exercise is when the user with one arm pulls himself/herself towards the door, the own body being the counterweight. Also in this case the first strap 1 will be displaced in its longitudinal direction relative to the shackle 12.

Figure 4:
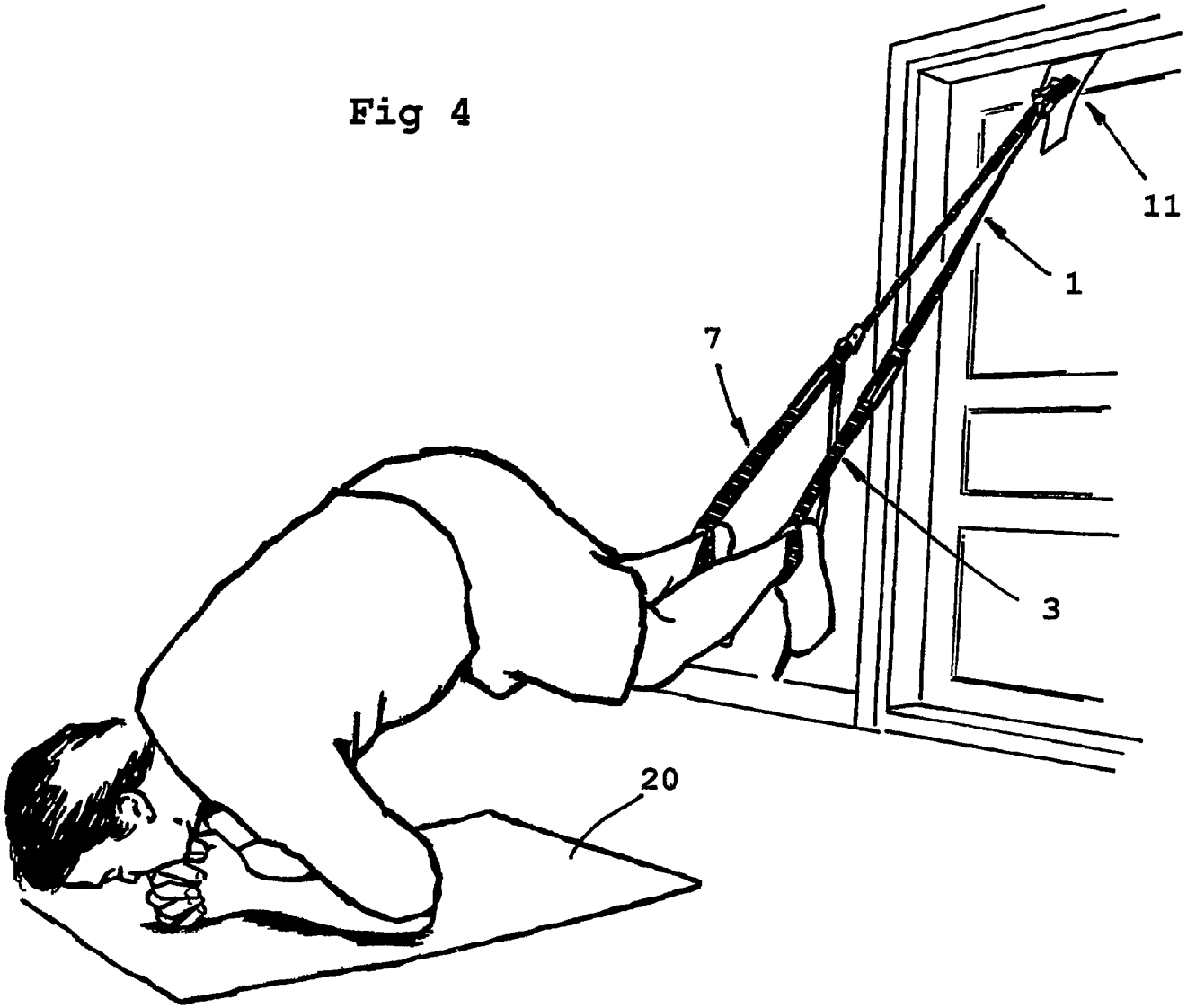
FIG. 4 shows schematically how a third exercise may be performed by means of the exercising device according to the present invention.

In FIG. 4 it is schematically shown how the exercising device according to the present invention is used to exercise the abdominal muscles. In connection therewith the loops 3 and 7 are located around the ankles of the user that is resting his/her forearms against the antislip mat. In order to guarantee that the feet of the user are not sliding out of the loops 3 and 7 it is suitable that the loops are equipped with Velcro tape (not shown) in order to reduce the size of the loops 3, 7. It is also possible to use separate clamps to reduce the circumference of the loops 3 and 7. In this case the anchorage means 11 is located between an upper horizontal edge of the door leaf and the adherent part of the frame.

As regards all the situations illustrated above the anchorage means 11 is attached between a part of the door leaf and an adherent part of the frame. Thereby, the bead 17 is located on the side of the door leaf that faces away from the user. Since the rod shaped element 18 constitutes a separate piece it is possible to remove said element 18 from the pocket 19 and insert the carrier 16 through the slot between the door leaf and the frame. Then the rod shaped element 18 may again be inserted in the pocket 19. This method may be practiced if it is difficult to mount the anchorage means 11 between the door leaf and the frame, see for instance FIG. 3.

Figure 5:
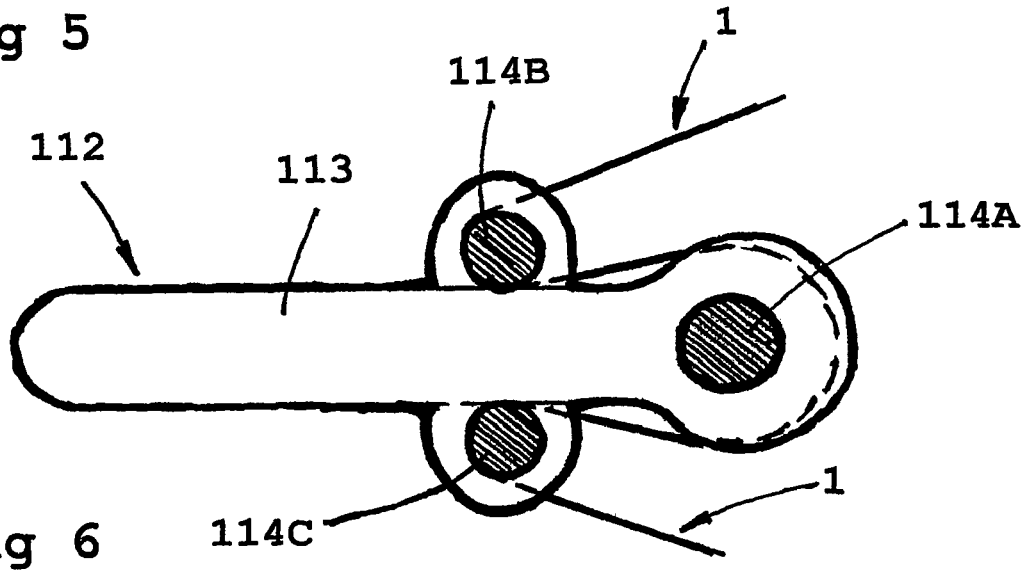
FIG. 5 shows a side view of an alternative embodiment of a schackle that is part of the exercising device.
Figure 6:
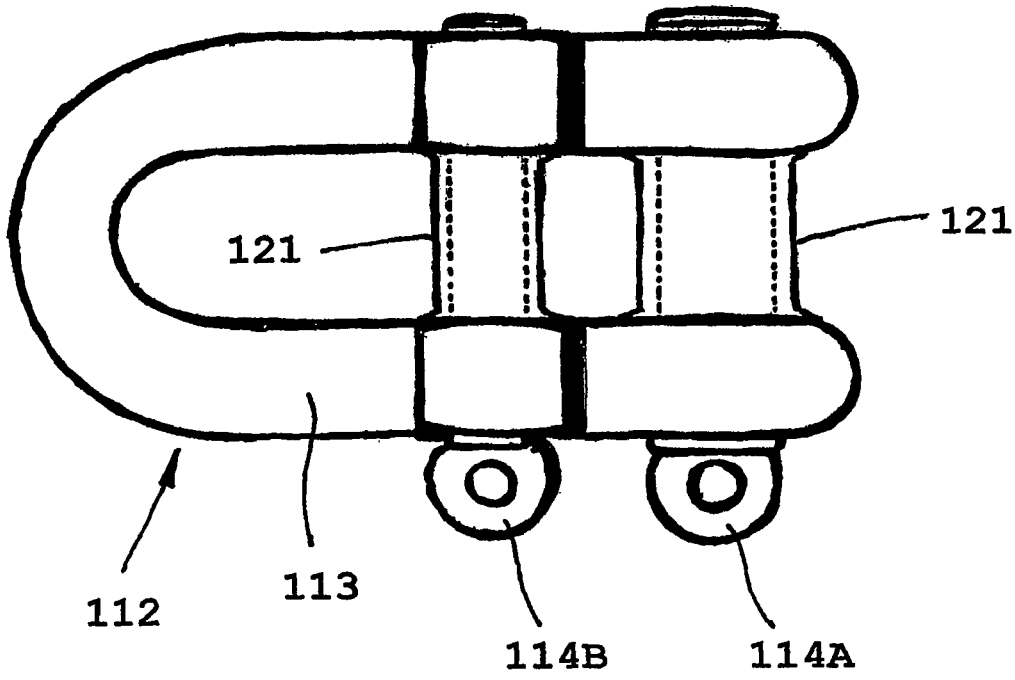
FIG. 6 shows a top view of the schackle according to FIG. 5.

In FIGS. 5 and 6 an alternative embodiment of a shackle 112 is shown, said shackle 112 comprises a yoke 113 and three threaded screws 114A, 114B and 114C. On each screw 114A, 114B and 114C sleeves 121 are rotatably mounted. The centre of the sleeves 121 are generally located at the corners of an imaginary triangle, said triangle having the base facing towards the left in FIG. 5. Of course the mutual orientation of the sleeves 121 that is shown in FIGS. 5 and 6 constitutes only an example. By choosing suitable material in the sleeves 121 the friction between the sleeves 121 and the screws 114A, 114B and 114C may be varied, i.e. the rolling resistance between the sleeves 121 and the screws 114A, 114B and 114C may be varied.

In FIG. 5 it is schematically illustrated how the first strap 1 is intended to run through the shackle 112. Thereby, it is realized that the resistance that acts on the first strap 1 is generally higher compared to the resistance of the shackle 12. This is due to the change of direction of the strap 1 that occurs when the strap 1 runs through the shackle 112. Further, said resistance of the shackle 112 may also be varied by the choice of sleeves 121 as pointed out above. It is also possible to remove the sleeves 121 and then the first strap 1 is abutting directly against the screws 114A, 114B and 114C. A further possibility is offered by removing the screws 114B and 114C with adherent sleeves 121. Then the shackle 112 will function in principal like the shackle 12, i.e. the first strap 1 runs over one screw 114A only, that either may have a sleeve 121 or not. There is also the possibility that the screw 114A is removed and the strap 1 runs over the screws 114B and 114C that either may be equipped with sleeves 121 or not.

As regards the exercising device that has been described above it is a general rule that when the user is leaning further backwards a higher resistance is generated when the strap 1 is displaced in its longitudinal direction relative to the shackle 12; 112. Generally, the shackle 12 shown in FIG. 1 creates a lower resistance while the shackle 112, shown in FIGS. 5 and 6, creates a somewhat higher resistance. Thereby, the persons that for some reason do not want to lean backwards may still have a sufficient resistance by using the shackle 112 according to FIGS. 5 and 6. Besides, further variation of the resistance of the shackle 112 according to FIGS. 5 and 6 may be achieved by a suitable choice of sleeves 121.

FEASIBLE MODIFICATIONS OF THE INVENTION

In the embodiment of the present invention that is shown in the figures the second loop 7 is connected to the first strap 1 by means of a buckle 9. However, within the scope of the present invention it is also feasible that both loops are connected to the first strap 1 by means of buckles.

In the embodiment shown in the figures the loops 3 and 7 have essentially the same dimensions, i.e. the length/circumference of the loops 3, 7 are essentially the same. However, within the scope of the present invention it is feasible that only one loop has such dimensions that location around the body, preferably the waist, of the user is possible. The second loop is in such a case dimensioned to receive only a hand, an arm or a leg of the user.

As regards the embodiment of the shackle 112 that is described in FIGS. 5 and 6 it is stated that the shackle 112 may be used both with and without sleeves 121. Within the scope of the present invention it is also feasible that the screws 114A, 114B, 114C are equipped with some kind of coating that brings about a suitable friction between the strap 1 and the screws 114A, 114B, 114C. When the coating is worn out the screw in question is replaced by a new one.

Within the scope of the present invention it is also feasible that the design of the shackle is such that it comprises two plates at a certain mutual distance and that the plates are connected by means of fixed sleeves or solid rods. The number of sleeves/rods may be one, three or more.

The invention claimed is:

1. Exercising device that comprises:

a first strap (1);

loops (3,7) attached to the first strap (1), at least one of the loops (3,7) having a length/circumference in the interval 110-180 cm to extend around a waist of a user;

a shackle that is adapted to be fixed to a base and through which said first strap runs in such a way that the first strap (1) is displaceable in its longitudinal direction relative to the shackle, the shackle comprises a U-shaped member having a rod adjoining the ends of the U-shaped member on which said first strap is longitudinally displaceable during operation of the exercising device when said first strap is carrying the counterweight of a user pulling on said loops; and tubular handles (10) mounted on the loops (3,7) and displaceable relative to the loops (3,7), wherein said at least one of the loops (3,7) comprises a second strap that has a larger width than an internal diameter of the tubular handles (10) so that one said tubular handle on said at least one loop maintains a position on said second strap to which said one tubular handle has been displaced when said at least one loop extends around a waist of a user.

2. Exercising device according to claim 1, further comprising a sheet-shaped carrier (16) to which the shackle is attached, a pocket (19) integrated with the carrier (16) and a rod shaped element (18) that is adapted to be mounted in the pocket (19).

3. Exercising device according to claim 1, wherein at least one said loop (7) is connected to the first strap (1) by means of a buckle (9).

4. Exercising device according to claim 1, further comprising an anti-slip mat (20) for user to stand upon when using the exercising device.

5. Exercising device according to claim 1, wherein the rod carries a sleeve (121).

6. Exercising device according to claim 1, wherein the shackle (112) comprises three rods that each selectively carries said first strap to vary a resistance to the longitudinal displacement of said first strap through said shackle.

7. Exercising device according to claim 2, further comprising an anti-slip mat (20) for user to stand upon when using the exercising device.

8. Exercising device according to claim 3, further comprising an anti-slip mat (20) for user to stand upon when using the exercising device.

9. Exercising device according to claim 5, wherein said sleeve is rotatably mounted on said rod.

10. Exercising device according to claim 6, wherein at least one of the rods has a sleeve rotatably mounted thereon.

11. Exercising device according to claim 6, wherein and the three rods are arranged at corners of a triangle when viewed in a side view, with a base of the triangle being perpendicular to a plane of the U-shaped member and facing a closed end thereof.

12. Exercising device according to claim 1, further comprising a friction-setting coating on said rod.

13. Exercising device according to claim 2, wherein said sheet-shaped carrier has a length that extends beyond said shackle so that said shackle rests on said sheet-shaped carrier.

14. An exercising device comprising:

a first strap (1) having a length of 250-350 cm;

a first loop (3) attached to said first strap;

a second loop (7) attached to said first strap remote from said first loop, said second loop being attached to said first strap with a buckle (9) that selectively sets a position of attachment of said second loop to said first strap, said second loop having a length of 110-180 cm to extend around a waist of a user;

a sheet-shaped carrier (16) having a pocket (19) and a part (18) insertable into said pocket that increases a dimension of said carrier to selectively hold said carrier on a base;

a shackle (12) attached to said carrier, said shackle being shorter than said carrier so that said shackle rests on said carrier, said shackle carrying a rod (14) having a strap-carrying surface on which said first strap is longitudinally displaceable during operation of the exercising device when said first strap is carrying the counterweight of a user pulling on said first and second loops; and first and second tubular handles (10) longitudinally displaceable on respective ones of said first and second loops, said second loop comprising a portion that has a width larger than an internal diameter of said second tubular handle so that said second tubular handle maintains a position on said portion to which said second tubular handle has been displaced when said second loop extends around a waist of a user.

15. The exercising device of claim 14, wherein said shackle comprise three rods that each selectively carries said first strap to vary a resistance to the longitudinal displacement of said first strap through said shackle.

16. The exercising device of claim 14, further comprising a friction-setting coating on said rod.

17. The exercising device of claim 14, further comprising a rotatable sleeve on said rod.

* * * * *